US006178670B1

(12) United States Patent
Susman et al.

(10) Patent No.: US 6,178,670 B1
(45) Date of Patent: Jan. 30, 2001

(54) UNDERWATER MINING APPARATUS

(75) Inventors: Hector Fillipus Alexander Van Drentham Susman; Kenneth Roderick Stewart, both of Aberdeen (GB)

(73) Assignee: Rotech Holdings Limited, Aberdeen (GB)

( * ) Notice: Under 35 U.S.C. 154(b), the term of this patent shall be extended for 0 days.

(21) Appl. No.: 09/101,293

(22) PCT Filed: Jan. 6, 1997

(86) PCT No.: PCT/GB97/00018

§ 371 Date: Jan. 8, 1999

§ 102(e) Date: Jan. 8, 1999

(87) PCT Pub. No.: WO97/25488

PCT Pub. Date: Jul. 17, 1997

(30) Foreign Application Priority Data

Jan. 6, 1996 (GB) ..... 9600242

(51) Int. Cl.[7] ..... B63C 11/52

(52) U.S. Cl. ..... 37/313; 37/317; 37/321; 37/322; 37/905; 405/191; 175/107; 299/9

(58) Field of Search ..... 37/307, 313, 317, 37/319, 320, 321, 322, 905; 297/9; 405/190, 191; 175/107

(56) References Cited

U.S. PATENT DOCUMENTS

| | | | | |
|---|---|---|---|---|
| 1,401,994 | * | 1/1922 | Lockley | 37/317 |
| 3,905,137 | | 9/1975 | Gee . | |
| 3,990,377 | * | 11/1976 | Marquinez . | |
| 4,053,181 | * | 10/1977 | Saito | 299/9 |
| 4,204,347 | * | 5/1980 | Wolters | 37/313 X |
| 4,232,903 | * | 11/1980 | Welling et al. | 299/9 |
| 4,368,923 | | 1/1983 | Handa et al. . | |
| 4,391,468 | | 7/1983 | Funk . | |
| 4,398,362 | * | 8/1983 | Weinert . | |
| 4,503,629 | * | 3/1985 | Uchida . | |
| 4,685,742 | * | 8/1987 | Moreau . | |
| 4,979,322 | | 12/1990 | Sloan . | |
| 5,146,699 | * | 9/1992 | Lipford | 37/319 |
| 5,518,379 | * | 5/1996 | Harris et al. . | |

FOREIGN PATENT DOCUMENTS

| | | |
|---|---|---|
| 78952 87 | 3/1988 | (AU) . |
| 0 091 264 | 10/1983 | (EP) . |

* cited by examiner

*Primary Examiner*—H. Shackelford
(74) *Attorney, Agent, or Firm*—Jacobson, Price, Holman & Stern, PLLC

(57) ABSTRACT

There is provided an improved apparatus for recovery of sea-bed material. Known apparatus suffer from problems such as low recovery rate and capital cost. The invention, therefore, provides a recovery apparatus comprising a vehicle upon which are mounted a duct permitting communication between the sea-bed and a location remote therefrom, structure to introduce sea-bed material into the duct and structure to advance sea-bed material through the duct.

35 Claims, 6 Drawing Sheets

UNDERWATER MINING APPARATUS

Figure 1:
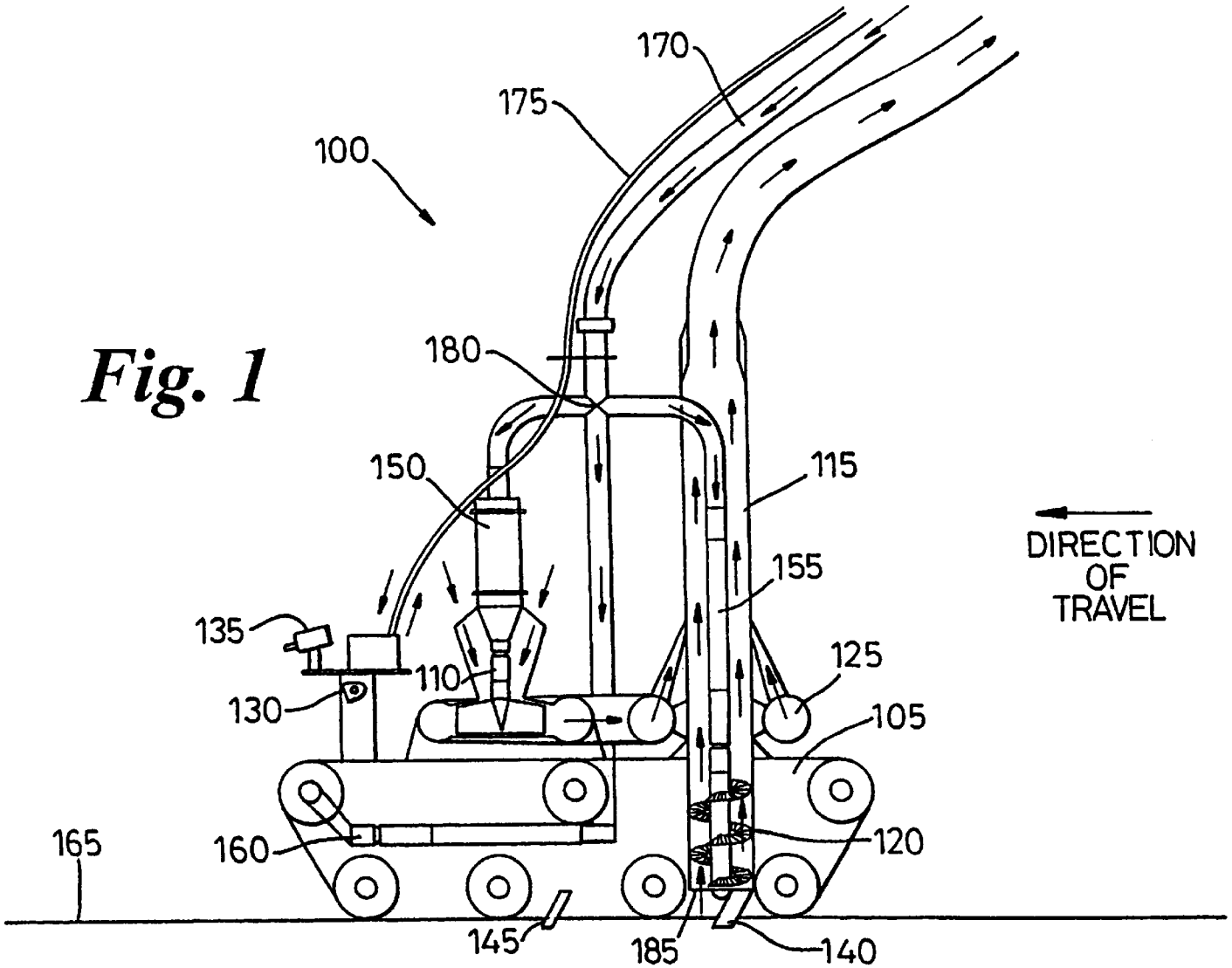

The present invention relates to underwater mining apparatus and in particular, though not exclusively, to apparatus for the recovery of high value deposits such as gem stones and precious metals.

The existence of mineral deposits on the floor of oceans, seas, rivers, lakes, lochs and the like has long been known but the recovery of these deposits has been economically unviable. Hereinafter the term "sea-bed" is used to identify an ocean, sea, river, lake or loch floor, or the like. As land based reserves become depleted and hence more expensive to extract, attention has been turned to the mining of underwater mineral reserves. Recovery is complicated by both the water depth at which these minerals are to be found and their location often either on or a few meters below the seabed. Such recovery is presently performed at depths of up to 200 meters and involves the transport of quantities of sea-bed material to a surface vessel followed by a sifting operation to extract the desired mineral(s).

Known recovery operations are performed by either Remotely Operated Vehicles (ROV) or air-lift apparatus. Recovery via ROV employs a submersible vehicle, which may be either electrically or hydraulically powered, to transport small bucket loads of sea-bed material to the surface. ROV's have a low recovery rate and hence are a slow and expensive method of transport.

The air-lift method involves admitting compressed air into the lower end of a pipe immersed in the sea-bed. This creates alternate zones of sea-bed material and air within the pipe which are forced to the surface by the greater hydrostatic pressure of the surrounding water.

Such apparatus is extremely capital intensive and typically requires a large number of diesel driven air compressors which accommodate a great deal of vessel deck space. Air-lift apparatus is, in addition, inefficient and expensive to run and maintain. Licences are currently being issued for the exploitation of mineral reserves at depths of up to 600 meters, depths which make the use of air-lift or ROV apparatus even less desirable.

It is an object of the present invention to obviate or mitigate at least some of the aformentioned disadvantages.

Accordingly, the present application provides an apparatus for recovery of material from a floor of a body of water, the apparatus providing a vehicle and a duct mounted on the vehicle and permitting communication between the floor and a location remote therefrom, in use, the vehicle having means for allowing movement of the vehicle, means to introduce material into the duct, and means to advance material through the duct, and wherein further the apparatus has non-return means within the duct which acts to prevent movement of material upstream within the duct.

Thus, in use, material can be recovered from the floor of the body of water via the duct to a remote location, e.g. on a surface vessel or structure.

Preferably, the means to introduce material into the duct include at least one scoop and/or other material accumulation apparatus.

Preferably, the non-return means comprises at least a portion of a rotatable body having an external thread, the rotatable body being provided longitudinally within the duct.

Advantageously, the vehicle has a base and the non-return means is disposed along an axis extending at an angle from the base.

Advantageously also, the rotatable body comprises an auger.

Preferably, means for moving the vehicle, the means to introduce material in the duct and the means to advance material through the duct are powered by hydraulic means.

Preferably also, the non-return means are powered by hydraulic means.

An entrance to the duct may be provided at or near a base of the vehicle while an exit from the duct is provided above a surface of the body of water.

Preferably, there is provided means for steering the vehicle.

Preferably, the vehicle may be provided with wheels, tracks or a combination thereof, and may be provided with control systems to allow it to be operated from a remote location.

The means for introducing material into the duct may comprise at least a portion of the auger, said at least one auger being provided substantially within the duct, and preferably at or near the duct entrance.

Advantageously, there may be at least one scoop and/or other accumulation apparatus, for example angled blades and/or ploughshares, provided in the vicinity of an entrance to the duct so as to direct material into the duct.

The at least one scoop and/or other such accumulation means may be moveable by actuation means.

Screens or fenders may be provided ahead of the duct entrance to prevent the ingress of undesirable material such as oversize pieces of rock and other such debris.

Preferably a/the duct entrance, scoop(s) and/or other material accumulation apparatus, and screens or fenders may be provided on the underside of the steerable vehicle.

The means for advancing the material through the duct may take the form of at least one ejection pump which introduces pressurised fluid into the duct.

The at least one ejection pump may introduce fluid into the duct through at least one port provided in a wall of the duct, preferably, at a point downstream of the non return means.

Preferably, the at least one ejection pump is supplied with pressurized fluid by at least one centrifugal pump mounted on the vehicle.

Preferably, the auger, the at least one centrifugal pump and the means for steering the vehicle are powered by one or more hydraulic motors.

Preferably, the motive fluid for the motor(s) is/are pressurised water.

The motor(s) may be provided with a single motive fluid supply hose and distribution means to apportion motive fluid between the motors.

The/each motor may be a drilling motor.

The/each motor may be a "Moineau" (Registered Trade Mark), hydraulic or suitably adapted electric motor.

Alternatively, and advantageously the/each motor may comprise a stator and a rotor rotatably mounted in the stator, the stator being provided with a rod recess and an exhaust port, the rotor being provided with a rotor channel and at least one channel for conducting motive fluid from the rotor channel to a chamber between the rotor and the stator, the rod recess being provided with a rod which, in use, forms a seal between the stator and the rotor. Such a drilling motor is described in U.S. Pat. No. 5,833,444 (SUSMAN et al).

Although not essential, it is highly desirable that the rotor be provided with a seal for engagement with the stator.

Preferably, the seal is made from a material selected from the group consisting of plastics materials, polyethylethylketone, metal, copper alloys and stainless steel.

Advantageously, the rod is made from a material selected from the group of plastics materials, polyethylethylketone, metal, copper alloys and stainless steel.

Preferably the stator is provided with two rod recesses which are disposed opposite one another, and two exhaust ports which are disposed opposite one another, each of the rod recesses being provided with a respective rod, the rotor having two seals which are disposed opposite one another.

The/each motor may advantageously comprise two drilling motors arranged with their respective rotors connected together each motor comprising a stator and a rotor rotatably mounted in the stator, the stator being provided with a rod recess and an exhaust port, the rotor being provided with a rotor channel and at least one channel for conducting motive fluid from the rotor channel to a chamber between the rotor and the stator, the rod recess being provided with a rod which, in use, forms a seal between the stator and the rotor.

Preferably, the two drilling motors are connected in series, although they could be connected in parallel if desired.

Advantageously, the two drilling motors are arranged so that, in use, one drilling motor operates out of phase with the other. Thus, in a preferred embodiment each drilling motor has two chambers and the chambers in the first drilling motor are 90° out of phase with the chambers in the second drilling motor. Similarly, in an embodiment in which each drilling motor has four chambers, the chambers in the first drilling motor would preferably be 45° out of phase with the chambers on the second drilling motor. This arrangement helps ensure a smooth power output and inhibits stalling.

Figure 2:
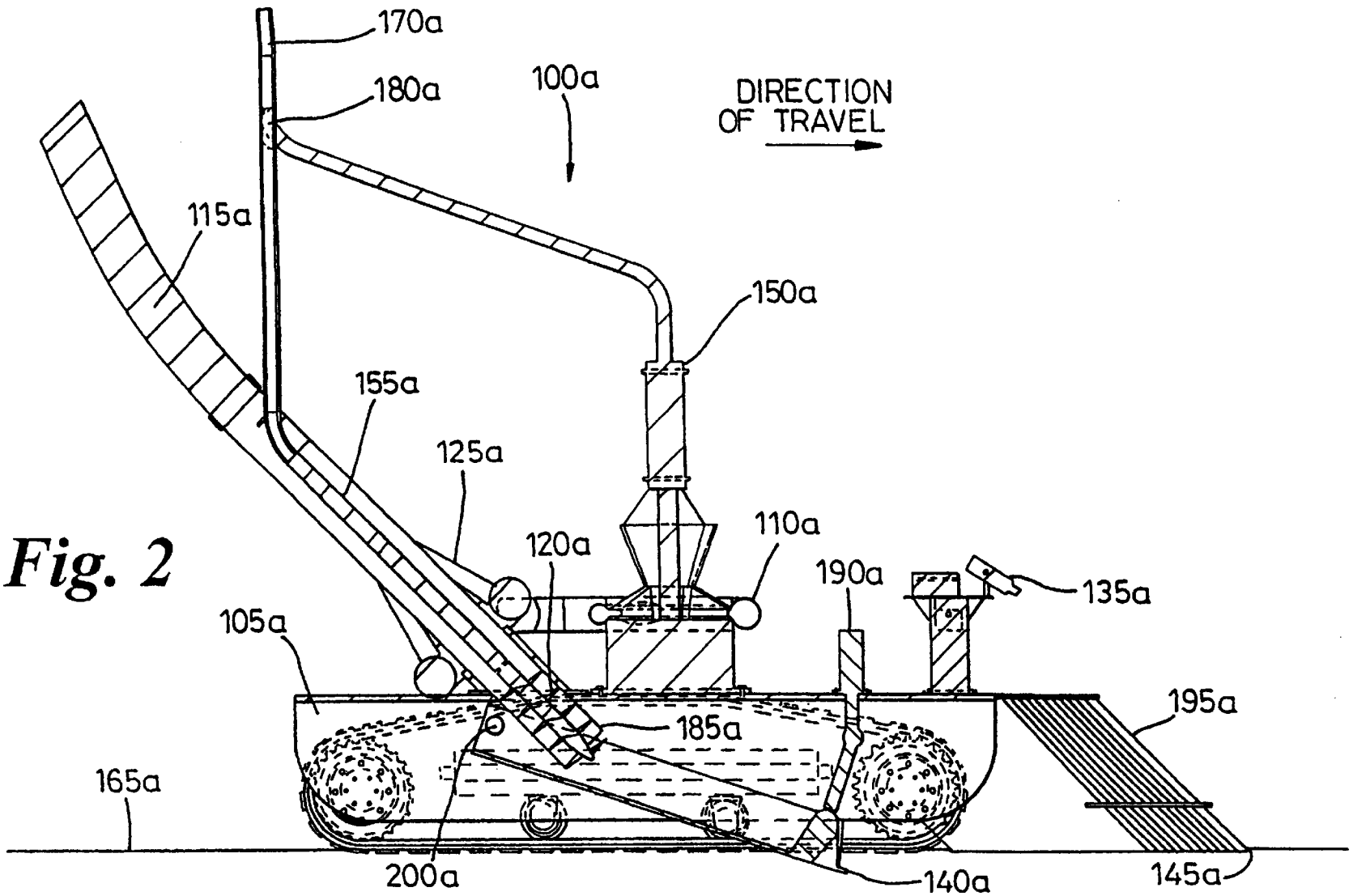
Figure 3:
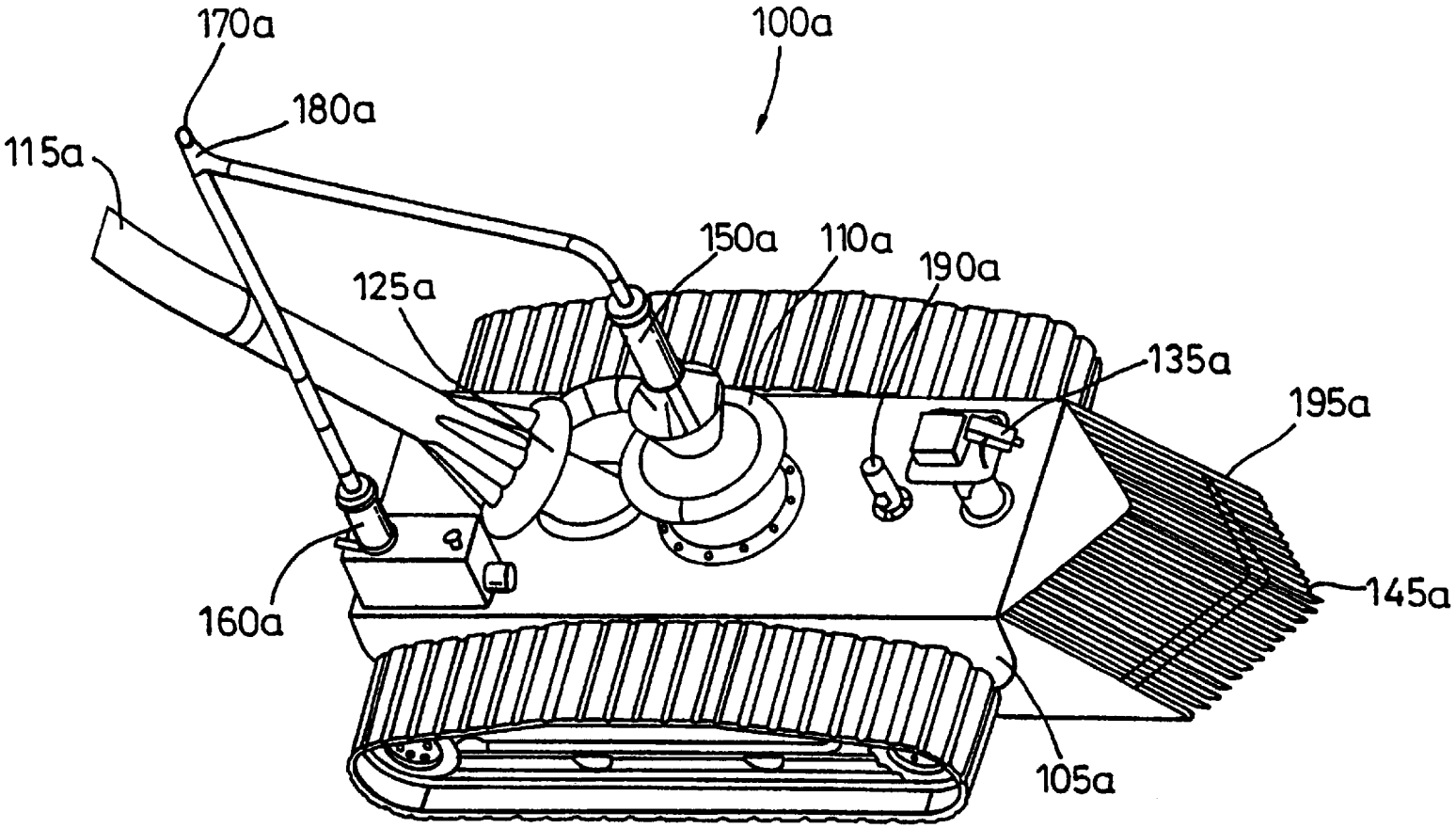
Figure 4:
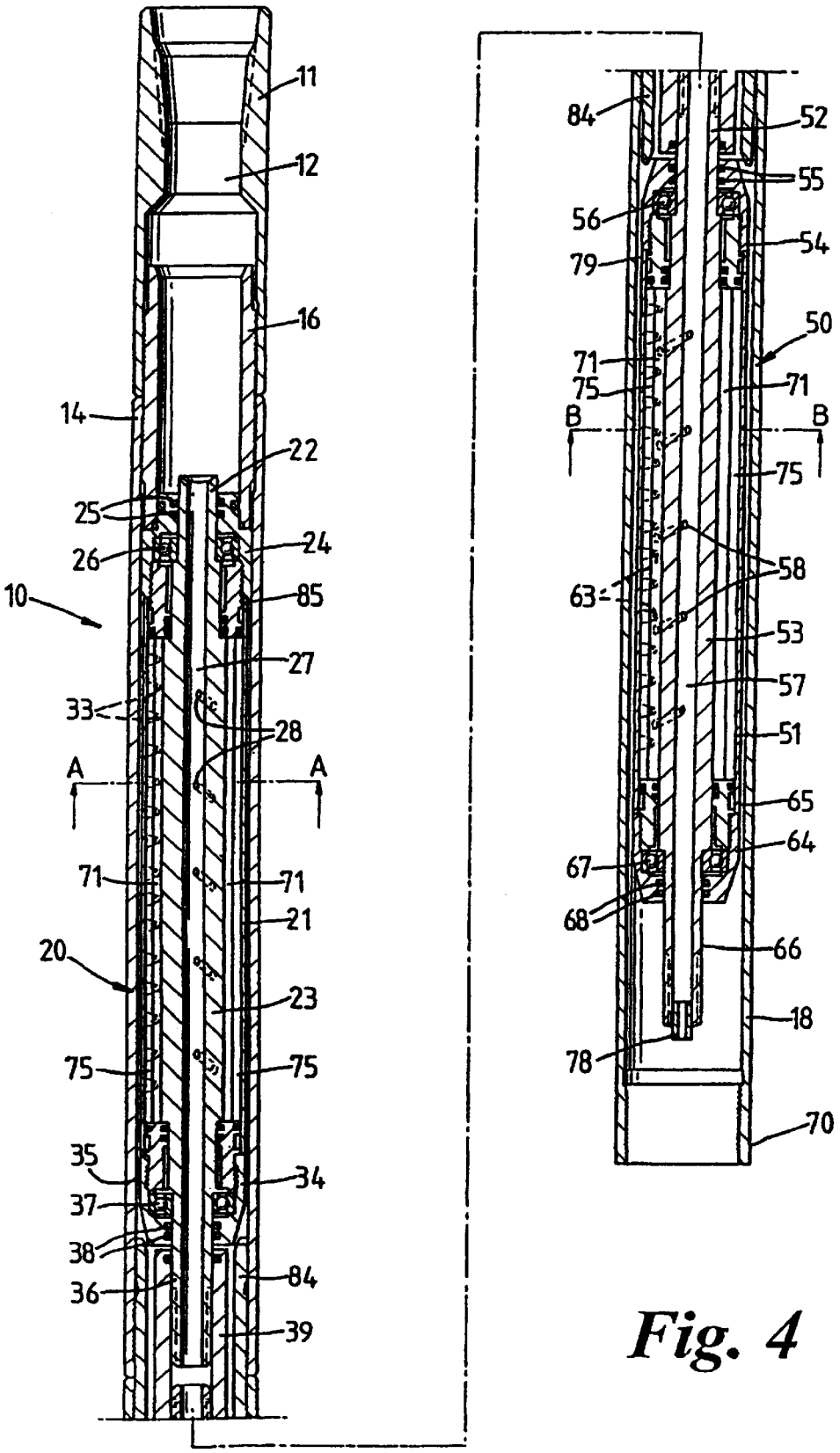

Embodiments of the present invention will now be described, by way of example only, with reference to the following drawings which are:

FIG. 1 a side view of a first embodiment of an apparatus in accordance with the present invention;

FIG. 2 a side view of a second embodiment of an apparatus in accordance with the present invention, FIG. 3 a view from above and to one side of the apparatus shown in FIG. 2, FIG. 4 a longitudinal cross sectional view of a hydraulic motor of the type utilised by the present invention;

FIGS. 5A–5D cross sectional views along the line A—A of FIG. 2 showing a rotor in four different positions; and FIGS. 6A–6D cross sectional views along line B—B of FIG. 2 showing a rotor in four different positions.

Referring to FIG. 1 there is shown a recovery apparatus 100 in accordance with a first embodiment of the present invention. The apparatus 100 comprises a tracked carrier vehicle 105 upon which is mounted a centrifugal pump 110, a transfer duct 115 to convey material from the sea-bed 165 to the surface (eg to a surface vessel), an auger 120 mounted within the duct 115 to lift material from the sea-bed 165 into the duct 115, and an ejection pump 125 to force said material through the duct 115. The apparatus 100 is further provided with equipment such as lights 130 and a video relay 135 to permit remote operation from a surface vessel, and also with a scoop(s) 140 and screens/fenders 145 to direct material either towards or away from the duct entrance 185.

Power for the auger 120, centrifugal pump 110 and carrier vehicle 105 is provided by three hydraulic motors 150, 155, 160, for example, of the type used for downhole drilling operations, the operating principles of which are described below. In this particular embodiment the motive fluid is pressurised water.

In use, the apparatus 100 is deposited on the sea-bed 165 from which material is to be collected. The apparatus 100 is connected to a surface vessel via the transfer duct 115, a motive fluid supply hose 170 and a control umbilical 175. Motive fluid supplied to the apparatus 100 is split between the three motors 150, 155, 160 by distribution means 180 aboard the carrier vehicle 105. The distribution may be either fixed or variable depending on the recovery tasks the apparatus 100 has to perform.

As the tracked vehicle 105 traverses the sea-bed 165, the front screen/fender 145 acts to move objects above a certain size out of the vehicles path and thus prevents such from entering the scoop 140. The scoop 140 may project a preset distance into the sea-bed 165 or may, in operation, vary its depth depending on local conditions. Material captured in the scoop 140 is lifted into the transfer duct 115 by the auger 120. Once within the duct 115 the sea-bed material is transported to the surface vessel under the influence of pressurised water introduced into the transfer duct 115 by the ejection pump 125. The ejection pump 125 is supplied by the hydraulic motor driven centrifugal pump 110 and it is envisaged that material will be transported to the surface at a speed of typically around 5 meters per second. Thus the auger 120 causes material to be pushed up mechanically as far as the outlets of the ejection pump 125. The operation of the ejection pump 125 thereafter causes material to be transported along the duct 115. It is further envisaged that apparatus 100 in accordance with the present invention will be able to typically recover around 4000 tonnes of seabed material per day; an increase of around 2000 tonnes over present recovery systems.

The operation of the recovery apparatus 100 and its subsystems may be controlled from the surface vessel via the control umbilical 175. Aspects of the apparatus operation which may be controlled thus include, for example, the vehicle speed and direction and the depth of the scoop 140.

Referring now to FIGS. 2 and 3 there is illustrated a second embodiment of a recovery apparatus according to the present invention, generally designated 100*a*, like parts being identified by the same integers as in the first embodiment shown in FIG. 1 but suffixed by the letter "a".

In the second embodiment the scoop 140*a* is at least partially rotatable about a first end 200*a* by the provision of an actuator 190*a*. Thus the depth to which the scoop 140*a* projects into the sea-bed 165*a* may be varied, in use. The duct 115*a* and auger 120*a* are positioned towards the rear of the scoop 140*a* and are inclined at an angle to aid in the transfer of material from the scoop 140*a* to the duct entrance 185*a*.

The apparatus is further provided with a sloping painted fender 145*a* comprising a plurality of tines 195*a*.

The hydraulic motors utilised in the apparatus operate on the principles outlined in the applicants copending PCT application No. WO 95/19488. To aid in the understanding of the present invention, the operation of a drill motor embodying two such motors will now be described.

Referring to FIG. 4 there is shown a motor (drilling motor) generally designated 10. The drilling motor 10 comprises a first motor 20 and a second motor 50.

The first motor 20 comprises a stator 21 and a rotor 23. A top portion 22 of the rotor 23 extends through an upper bearing assembly 24 which comprises a thrust bearing 26 and seals 25.

Motive fluid, e.g. water, drilling mud or gas under pressure, flows down through a central sub channel 12 into a central rotor channel 27, and then out through rotor flow channels 28 into action chambers 31 and 32.

Following a motor power stroke, the motive fluid flows through exhaust ports 33 in stator 21, and then downwardly through an annular channel circumjacent the stator 21 and flow channels 35 in a lower bearing assembly 34. A portion 36 of the rotor 23 extends through the lower bearing assembly 34 which comprises a thrust bearing 37 and seals 38.

The ends of the stator 21 are castellated and the castellations engage in recesses in the respective upper bearing assembly 24 and lower bearing assembly 34 respectively to inhibit rotation of the stator 21. The upper bearing assembly 24 and lower bearing assembly 34 are a tight fit in an outer tubular member 14 and are held against rotation by compression between threaded sleeves 16 and 84.

A splined union 39 joins a splined end of the rotor 23 to a splined end of a rotor 53 of the second motor 50. The second motor 50 has a stator 51.

A top portion 52 of the rotor 53 extends through an upper bearing assembly 54. Seals 55 are disposed between the upper bearing assembly 54 and the exterior of the top portion 52 of the rotor 53. The rotor 53 moves on thrust bearings 56 with respect to the upper bearing assembly 54.

Motive fluid flows into a central rotor channel 57 from the central rotor channel 27 and then out through rotor flow channels 58 into action chambers 61 and 62. Following a motor power stroke, the motive fluid flows through exhaust ports 63 in stator 51, and then downwardly through an annular channel circumjacent the stator 51 and flow channels 65 in a lower bearing assembly 64. A portion 66 of the rotor 53 extends through a lower bearing assembly 64. The rotor 53 moves on thrust bearings 67 with respect to the lower bearing assembly 64 and seals 68 seal the rotor-bearing assembly interface. Also motive fluid which flowed through the flow channels 35 in the lower bearing assembly 34, flows downwardly through channels 79 in the upper bearing assembly 54, past stator 51 and through flow channels 65 in the lower bearing assembly 64.

The upper bearing assembly 54 and lower bearing assembly 64 are a tight fit in an outer tubular member 18 and are held against rotation by compression between threaded sleeve 84 and a lower threaded sleeve (not shown).

Figure 5A:
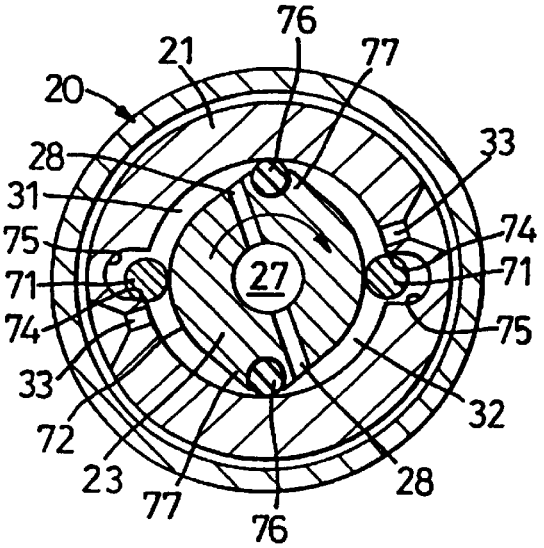
Figure 5B:
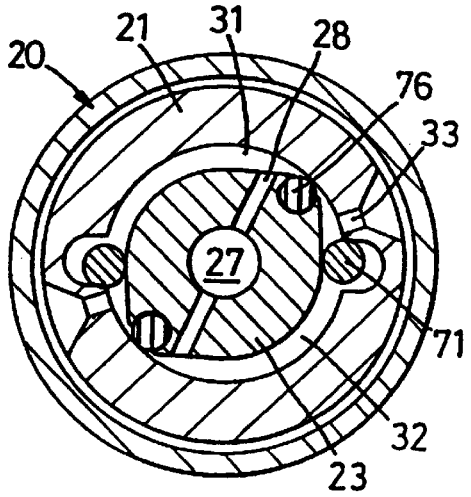
Figure 5C:
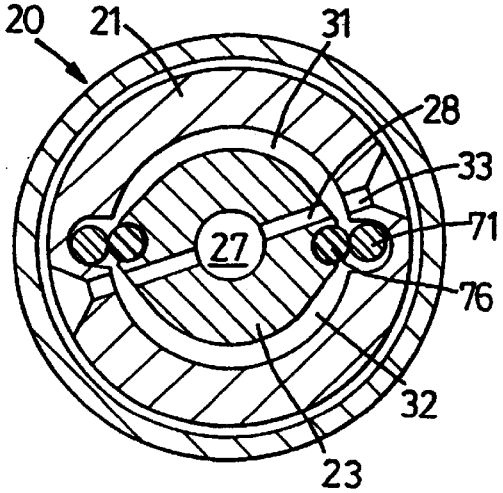

FIGS. 5A–5D and 6A–6D depict a typical cycle for the first and second motors 20 and 50 respectively, and show the status of the two motors with respect to each other at various times in the cycle. For example, FIG. 5C shows an exhaust period for the first motor 20 while FIG. 6C, at that same moment, shows a power period for the second motor 50.

As shown in FIG. 5A, motive fluid flowing through the rotor flow channels 28 enters the action chambers 31 and 32. Due to the geometry of the chambers (as discussed below) and the resultant forces, the motive fluid moves the rotor in a clockwise direction as seen in FIG. 5B. The action chamber 31 is sealed at one end by a rolling vane rod 71 which abuts an exterior surface 72 of the rotor 23 and a portion 74 of a rod recess 75.

At the other end of the action chamber 31, a seal 76 on a lobe 77 of the rotor 23 sealingly abuts an interior surface of the stator 21.

As shown in FIG. 5B, the rotor 23 has moved to a point near the end of a power period.

As shown in FIG. 5C, motive fluid starts exhausting at this point in the motor cycle through the exhaust ports 33.

Figure 5D:
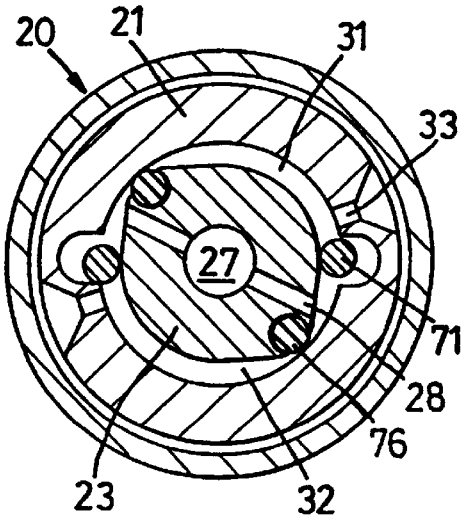
Figure 6A:
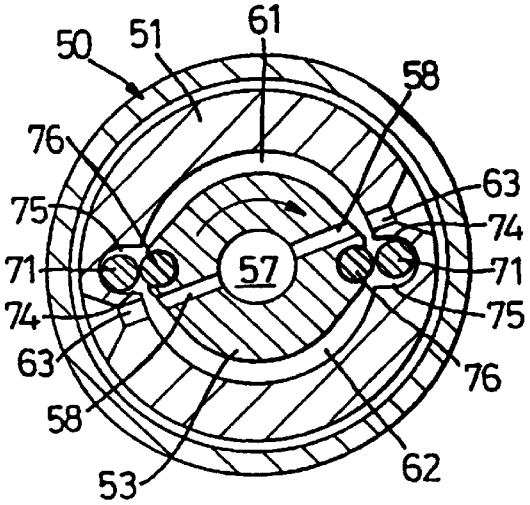
Figure 6B:
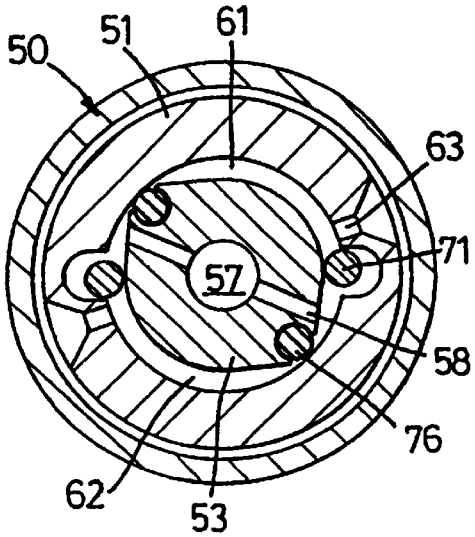
Figure 6C:
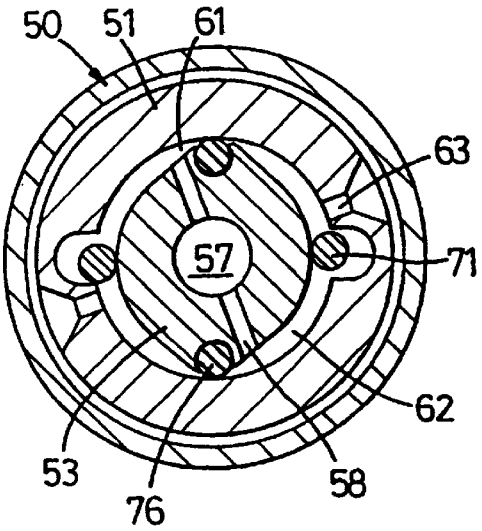
Figure 6D:
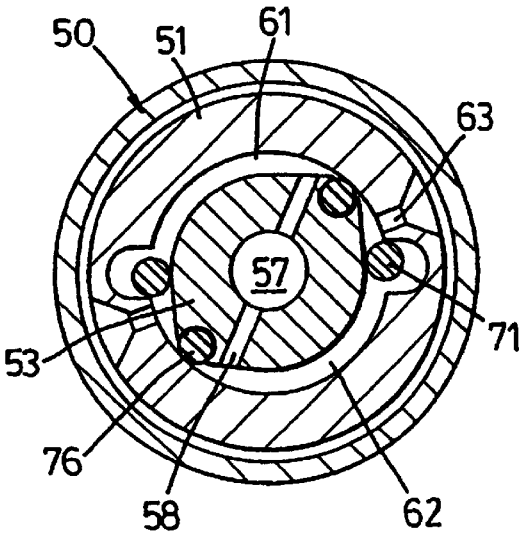

As shown in FIG. 5D, the rolling vane rods 71 and seals 76 have sealed off the action chambers and motive fluids flowing thereinto will rotate the rotor 23 until the seals 76 again move past the exhaust ports 33.

The second motor 50 operates as does the first motor 20; but, as preferred, and as shown in FIGS. 5A–5D, the two motors are out of phase by 90° so that as one motor is exhausting motive fluid the other is providing power.

The seals 76 are, in one embodiment, made of polyethylethylketone (PEEK). The rolling vane rods 71 are also made from PEEK. The rotors (23, 25) and stators (21, 51) are preferably made from corrosion resistant materials such as stainless steel.

When a seal 76 in the first motor 20 rotates past an exhaust port 33, the motive fluid that caused the turning exits and flows downward, then through the channels 79, past the exhaust ports 63 and the flow channels 65.

The embodiment of the present invention hereinbefore described is given by way of example only, and is not meant to limit the scope thereof in any way.

What is claimed is:

1. Apparatus for recovery of material from a floor of a body of water, the apparatus providing a vehicle and a duct mounted on the vehicle and permitting communication between the floor and a location remote therefrom, in use, the vehicle having means for allowing movement of the vehicle, means to introduce material into the duct, and means to advance material through the duct, and wherein further the apparatus has non-return means within the duct which act to prevent movement of material upstream within the duct.

2. Apparatus as claimed in claim 1, wherein the means to introduce material into the duct includes at least one of a material accumulation apparatus and at least one scoop.

3. Apparatus as claimed in claim 1, wherein the non-return means comprises at least a portion of a rotatable body having an external thread, the rotatable body being provided longitudinally within the duct.

4. Apparatus as claimed in claim 1, wherein the vehicle has a base and the non-return means is disposed along an axis extending at an angle from the base.

5. Apparatus as claimed in claim 3, wherein the rotatable body comprises an auger.

6. Apparatus as claimed in claim 1, further comprising hydraulic means for powering the means for moving the vehicle, the means to introduce material in the duct, and the means to advance material through the duct.

7. Apparatus as claimed in claim 1, further comprising hydraulic means for powering the non-return means.

8. Apparatus as claimed in claim 1, wherein an entrance to the duct is provided at or near the base of the vehicle while an exit from the duct is provided above a surface of the body of water.

9. Apparatus as claimed in claim 1, further comprising means for steering the vehicle.

10. Apparatus as claimed in claim 9, wherein the vehicle is provided with at least one of wheels and tracks, and is further provided with control systems to allow the vehicle to be operated from a remote location.

11. Apparatus as claimed in claim 5, wherein the means for introducing material into the duct comprises at least a portion of the auger.

12. Apparatus as claimed in claim 5, wherein the auger is provided at or near an entrance of the duct.

13. Apparatus as claimed in claim 2, wherein the at least one scoop and other accumulation apparatus is provided in the vicinity of an entrance to the duct so as to direct material into the duct.

14. Apparatus as claimed in claim 13, wherein the accumulation apparatus comprises at least one of at least one angled blade and at least one ploughshare.

15. Apparatus as claimed in claim 13, further comprising actuation means for moving the at least one scoop and other accumulation apparatus.

16. Apparatus as claimed in claim 8, further comprising one of screens and fenders provided ahead of the duct entrance to act to prevent ingress of undesirable material.

17. Apparatus as claimed in claim 16, wherein the means to introduce material into the duct includes at least one of material accumulation apparatus and at least one scoop, and wherein the entrance to the duct, the at least one of material accumulation apparatus, the at least one scoop, the screens, and the fenders are provided on an underside of the steerable vehicle.

18. Apparatus as claimed in claim 16, wherein the screens and fenders are provided at or near the front of the vehicle.

19. Apparatus as claimed in claim 1, wherein the means for advancing the material through the duct includes at least one ejection pump which introduces pressurized fluid onto the duct.

20. Apparatus as claimed in claim 19, wherein the duct has at least one port provided in a wall thereof at a point downstream of the non-return means, and wherein the at least one ejection pump introduces fluid into the duct through the at least one port.

21. Apparatus as claimed in claim 19, further comprising at least one centrifugal pump mounted on the vehicle, wherein the at least one ejection pump is supplied with pressurized fluid by the at least one centrifugal pump.

22. Apparatus as claimed in claimed 21, wherein the non-return means comprises at least a portion of a rotatable body having an external thread, the rotatable body being provided longitudinally within the duct, the rotatable body comprising an auger, and wherein the apparatus further comprises means for steering the vehicle and at least one hydraulic motor for powering the means for steering the vehicle.

23. Apparatus as claimed in claim 22, wherein the motive fluid for the at least one hydraulic motor is pressurized water.

24. Apparatus as claimed in claim 23, wherein the at least one hydraulic motor is provided with a single motive supply hose and distribution means for apportioning motive fluid to the at least one hydraulic motor.

25. Apparatus as claimed in claim 22, wherein the at least one hydraulic motor is a drilling motor.

26. Apparatus as claimed in claim 22, wherein the at least one hydraulic motor is a hydraulic motor.

27. Apparatus as claimed in claim 25, wherein the at least one hydraulic motor comprises a stator and a rotor rotatably mounted in the stator, the stator being provided with a rod recess and an exhaust port, the rotor being provided with a rotor channel and at least one channel for conducting motive fluid from the rotor channel to a chamber between the rotor and the stator, the rod recess being provided with a rod which, in use, forms a seal between the stator and the rotor.

28. Apparatus as claimed in claim 27, wherein the rotor is provided with a seal for engagement with the stator.

29. Apparatus as claimed in claim 28, wherein the seal is made from a material selected from the group consisting of plastics materials, polyethylethylketone, metal, copper alloys, and stainless steel.

30. Apparatus as claimed in claim 22, wherein the rod is made from a material selected from the group consisting of plastics materials, polyethylethylketone, metal, copper alloys, and stainless steel.

31. Apparatus as claimed in claim 30, wherein the stator is provided with two rod recesses which are disposed opposite one another, and two exhaust ports which are disposed opposite one another, each of the recesses being provided with a respective rod, the rotor having two seals which are disposed opposite one another.

32. Apparatus as claimed in claim 31, wherein the at least one motor comprises two drilling motors, each motor comprising a stator and a rotor rotatably mounted in the stator, the stator being provided with a rod recess and an exhaust port, the rotor being provided with a rotor channel and at least one channel for conducting motive fluid from the rotor channel to a chamber between the rotor and the stator, the rod recess being provided with a rod which, in use, forms a seal between the stator and the rotor, and the two drilling motors being arranged with their respective rotors connected together.

33. Apparatus as claimed in claim 32, wherein the two drilling motors are connected in series.

34. Apparatus as claimed in claim 32, wherein the two drilling motors are connected in parallel.

35. Apparatus as claimed in claim 32, wherein the two drilling motors are arranged so that, in use, one drilling motor operates out of phase with the other.

* * * * *